United States Patent [19]

Adachi

[11] Patent Number: 4,653,518

[45] Date of Patent: Mar. 31, 1987

[54] WASHING APPARATUS FOR CONTAINERS USED TO HOLD URINE

[76] Inventor: Shiro Adachi, 26 Uchihiranomachi, 2-chome, Higashi-ku, Osaka, Japan

[21] Appl. No.: 758,041

[22] Filed: Jul. 23, 1985

[51] Int. Cl.[4] ..... B08B 9/08

[52] U.S. Cl. ..... 134/62; 134/144; 134/167 R; 134/172; 211/89

[58] Field of Search ..... 134/62, 94, 144, 157, 134/158, 166 R, 167 R, 172, 180, 183, 95; 422/302, 303; 211/4, 81, 89

[56] References Cited

U.S. PATENT DOCUMENTS

| | | | |
|---|---|---|---|
| 547,927 | 10/1895 | Koch | 134/144 |
| 962,931 | 6/1910 | Thieme et al. | 134/62 |
| 1,597,129 | 8/1926 | Watters | 134/143 |
| 1,653,242 | 12/1927 | Underwood | 134/143 |
| 1,661,221 | 3/1928 | Hall | 134/143 |
| 2,133,481 | 10/1938 | Schroeder | 134/181 UX |
| 2,230,436 | 2/1941 | Roche | 134/167 R |
| 2,826,208 | 3/1958 | Boffa | 134/143 X |
| 3,645,283 | 2/1972 | Cassells | 134/143 X |

FOREIGN PATENT DOCUMENTS

| | | | |
|---|---|---|---|
| 254390 | 3/1967 | Fed. Rep. of Germany | 134/183 |
| 71886 | 2/1960 | France | 134/144 |

*Primary Examiner*—Harvey C. Hornsby
*Assistant Examiner*—Frankie L. Stinson
*Attorney, Agent, or Firm*—Moonray Kojima

[57] ABSTRACT

A washing apparatus for containers used to hold urine wherein a retaining member for retaining a plurality of urine containers arranged laterally in parallel is supported inside a body rotatably in one step or in a plurality of steps and a cover capable of closing a top opening of each urine container is disposed so as to be opened and closed in synchronism with the rotation of the retaining member, the cover and the urine container are rotated by a required angle by rotation transfer means so the urine may be discharged from the opening at a position where the top opening of the urine container faces downward, simultaneously the urine containers are cleaned successively or all at once automatically by cleaning agent and water ejected from a cleaning agent nozzle and a washing water nozzle provided at the positions corresponding to the opening and returning to the original state after the completion of the cleaning.

7 Claims, 12 Drawing Figures

WASHING APPARATUS FOR CONTAINERS USED TO HOLD URINE

BACKGROUND OF THE INVENTION

Field of the Invention

The present invention relates to a washing apparatus for containers used to hold urine in a urine test in a hospital, a sanatorium or a research laboratory and so on. There is no prior art as to such washing apparatus for containers used to hold urine. However, an apparatus for washing dishes and tableware by placing on a suspension apparatus and ejecting water or detergent and water from the rotating nozzle has been provided.

In the hospital, for the urine test, it is often the case that the urine of patients for a day or for several days are assumulated so that the color and the quantity thereof may be observed. However, after the test the urine must be disposed and the urine containers must be washed for the next test.

In the past, the work was entrusted to a handwork of a nurse and an apparatus for washing a number of urine containers having a fixed shape in bulk does not exist.

Specifically, the urine container must be always confirmed so as to be in accord with the name, age, sex and so on of the patient. A misconception or a change of the adjacent containers should never happen, thus further attention in addition to the washing means is required.

SUMMARY OF THE INVENTION

It is an object of the present invention to provide an apparatus comprising a number of same type of containers used to hold urine arranged in parallel laterally and capable of rotating thereof simultaneously by a fixed angle, discharging the urine thereform, washing and returning thereof to the original state.

It is another object of the present invention to provide a washing apparatus which is capable of washing each container automatically by moving a pair of nozzles ejecting cleaning agent and washing water, being disposed corresponding to the opening facing downward after discharging the urine by rotating a number of containers used to hold urine arranged in parallel laterally by a fixed angle.

It is a further object of the present invention to provide a washing apparatus, which is capable of washing quickly and efficiently without moving the nozzles by arranging a plurality of nozzles corresponding to the openings facing downward for ejecting cleaning agent and washing water toward respective openings, after discharging the urine by rotating a number of containers used to hold urine arranged in parallel laterally by a fixed angle.

It is an additional object of the present invention to provide a cover for each container used to hold urine for preventing a radiation of a bad odor from the container and an entering of dust thereinto in the preserved state of urine till the cleaning.

It is still another object of the present invention to provide an apparatus having a cover for each container used to hold urine mounted rotatably inside a body so as not to hinder the rotation of the container.

It is another object of the present invention to provide an apparatus which is capable of opening the covers closing the top openings of each container in synchronism with the rotation of a plurality of containers used to hold urine arranged in parallel laterally.

It is a further object of the present invention to dispose a plurality of containers used to hold urine arranged laterally individually to facilitate the taking in and out thereof.

It is still another object of the present invention to facilitate the movability of a body to any place optionally as a plurality of containers used to hold urine arranged laterally being retained as is.

DETAILED DESCRIPTION OF THE INVENTION

Embodiment 1

Figure 1:
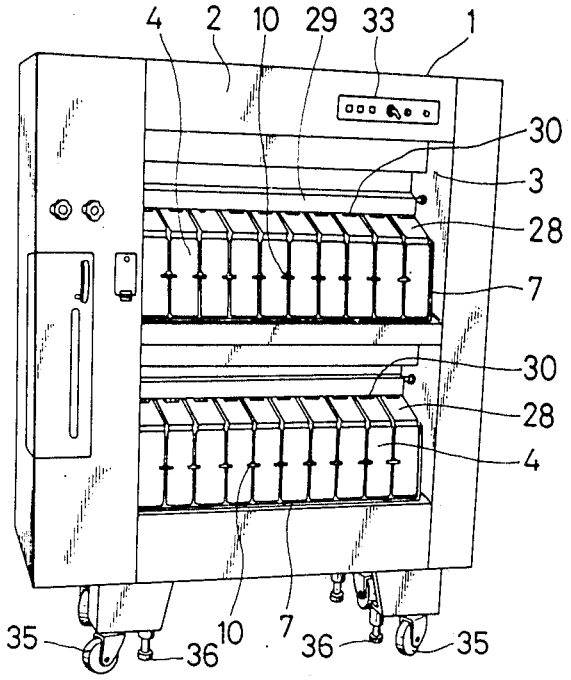
FIG. 1 is a perspective general view of a washing apparatus of the present invention.

In FIGS. 1 through 6, a body 1 comprises an external casing 2 and an inner case 3 and a front portion thereof is opened to facilitate the taking in and out of a container used to hold urine. The container 4 includes an opening 5 on the top and recesess 6 formed horizontally on the both side walls thereof.

Figure 3:
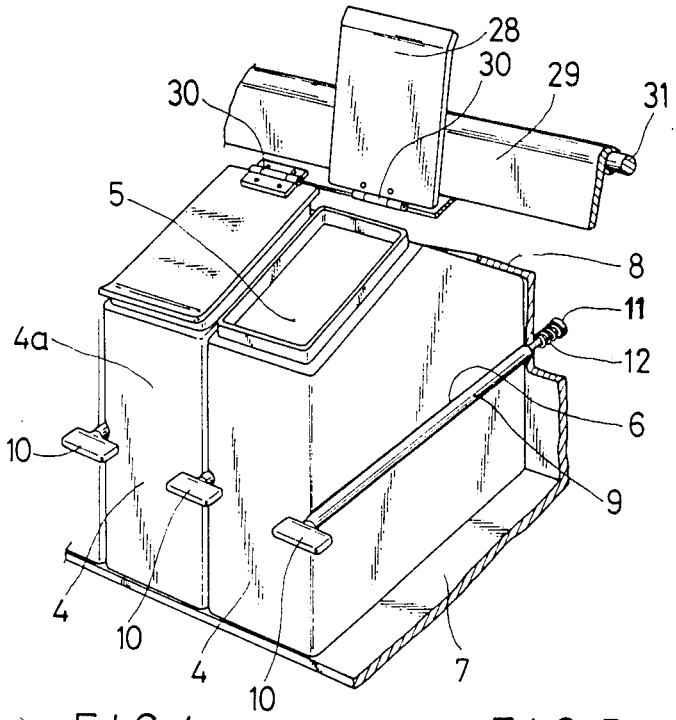
FIG. 3 is an enlarged perspective view showing a retained state of containers used to hold urine.

Now, the container 4 is formed with transparent synthetic resin or glass with a scale **4*a* on the front for reading out a quantity of urine contained therein visually (refer to FIG. 3). The retaining members 7 are disposed in two steps vertically inside the body 1 for placing a plurality of said containers laterally in parallel. The retaining member 7** is constituted by a placing floor plate, side plates protruding upward from both ends and a rear plate protruding upward from a rear end thereof.

An upper portion 8 of the rear plate aforementioned is slightly inclined forward, corresponding to the shape of a shoulder portion of the container 4 for holding the container 4 when the retaining member 7 previously mentioned is rotated. As shown in FIG. 3, rod members 9 engaging between each recess 6, 6 of the plurality of containers 4 arranged in parallel are supported through the rear plate of the retaining member 7 aforementioned. The rod 9 is provided with a blade-shaped pressing piece 10 on the front end together with a flange 11 and a spring 12 on the rear end, which is disposed between the rear plate and normally being forced to pull the rod 9 backward. Accordingly, the container 4 is constituted so as to be retained fixedly on the retaining member 7 previously mentioned by engaging with the rod 9 at the recesses 6, 6 and being pressed with the pressing piece 10 at the front forcibly by the spring 12.

The pressing piece 10 of the rod 9 aforementioned is disposed rotatably in such a manner that, it holds the container 4 previously mentioned in the horizontal state but it does not engage with the container 4 when it is turned in a vertical state, thus allowing the taking in and out of the container 4 freely.

Meanwhile, a retaining device of the container on the retaining member 7 aforementioned will not be limited to the above method, but the container 4 may be just retained rigidly in parallel on the retaining member 7 by any other means. The retaining member 7 is supported rotatably on the both side walls of the inner case 3 of the body 1 by the shaft 13 disposed on the both side plates thereof and is connected to a motor 16 via a chain wheel 14 provided on the one end of the shaft 13 and a chain 15 and arranged to rotate by a required angle. For example, it is constituted in such a way that the opening 5 of the container will face downward by rotating backward by approximately 180° about the shaft 13 of the retaining member 7 being placed with the container 4.

A cleaning agent tank 17 is provided between the external casing 2 and the inner case 3. A pump 18 is connected to the cleaning agent tank 17 aforementioned. One of ejecting nozzles 19 for cleaning agent is provided movably in a parallel direction of the containers under each container 4 previously mentioned and connected to the tank 17 via the pump 18 and a flexible tube 20. One of ejecting nozzles 21 for washing water is disposed under each container 4 in adjacent to the ejecting nozzle 19 for cleaning agent previously mentioned through a flexible tube 22 from the piping arranged between the inner case 3 in parallel to the piping of the ejecting nozzle 19 for cleaning agent. In the embodiment, although water is supplied to the ejecting nozzle 21 for the washing water aforementioned from a piping of the tap water suitably arranged, a tank and a pump may be used as same as the ejecting nozzle 19 for the cleaning agent previously mentioned. A numeral 23 repesents a motor for moving the nozzles. A screw shaft 24 disposed between the inner case 3 in a parallel direction of the containers is protruding at the one end from the inner case 3 on the side of the pump 18 aforementioned and connected rotatably to the motor 23 mentioned above via a chain wheel 25 and a chain 26. A nozzle retaining portion 27 having an inside screw is supporting the upper portions of the pipings for the ejecting nozzles 19 and 21 previously mentioned, and at the same time the screw shaft 24 aforementioned engages with the inside screw thereof movably. The retaining portion 27 mentioned above is guided in engagement with a moving guide rail so as not to rotate.

A cover 28 is for closing the opening 5 of the container 4 aforementioned. A numeral 29 represents a supporting portion of the cover 28 and provided with the cover 28 arranged in an open and close fashion manually with a hinge 30 for each individual container 4. The supporting portion 29 is mounted on a supporting shaft 31 disposed pivotally on the both side walls of the inner case 3 and constituted so as to be mated with the chain wheel 14 of the rotation transfer means of the retaining member aforementioned from the supporting shaft 31 via a parallel moving mechanism 32 (refer to FIG. 4) and pivoted upward together with the cover 28 previously mentioned.

Figure 4:
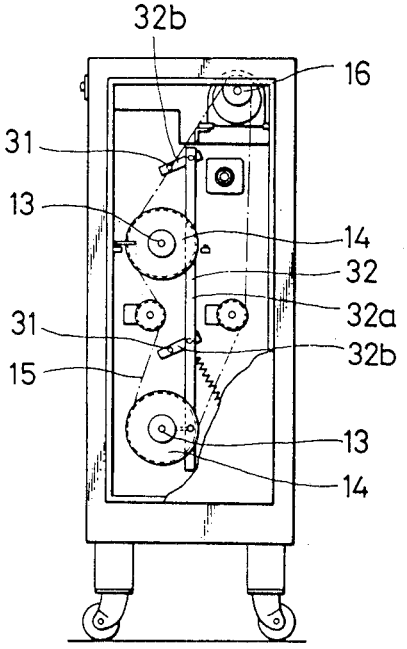
FIG. 4 is a side view showing rotation transfer means of a retaining member and a supporting portion.
Figure 5:
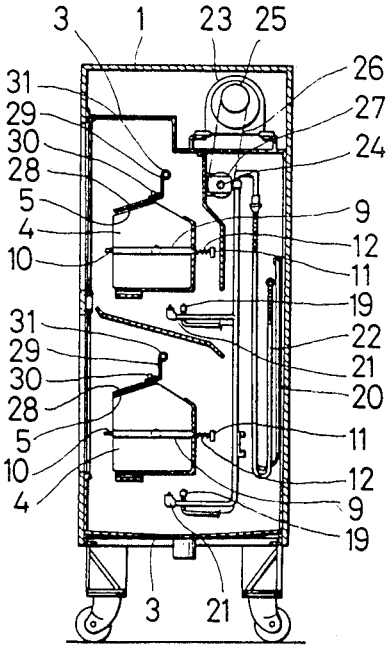
FIG. 5 is a sectional view of a body looking from the side.
Figure 6:
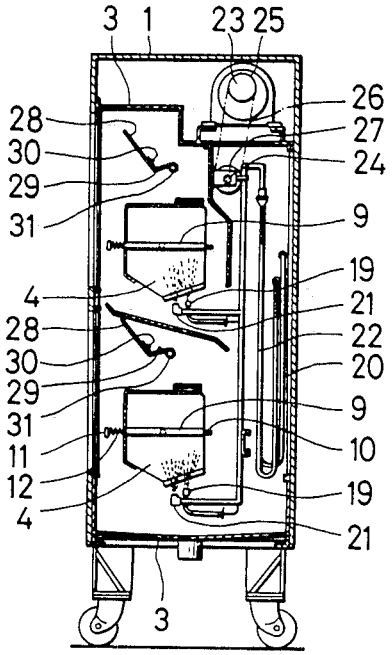
FIG. 6 is a sectional side view showing a retaining member and a cover in operation.
Figure 7:
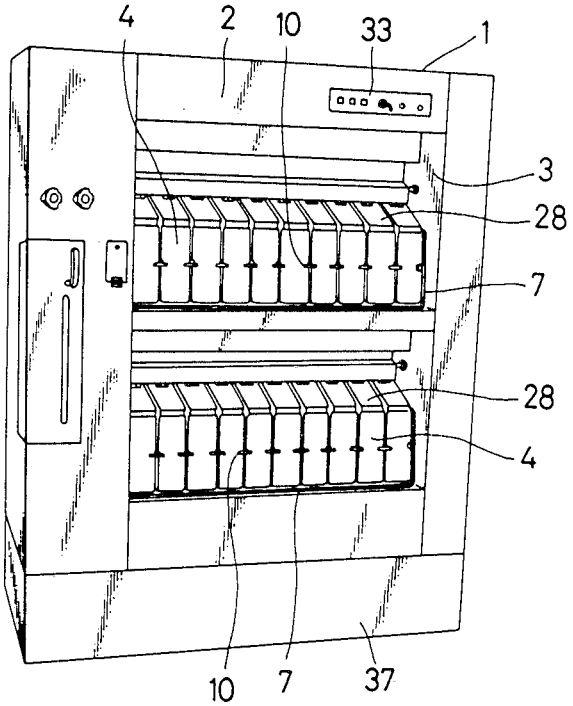
FIG. 7 is a perspective view of a washing apparatus showing another embodiment.
Figure 8:
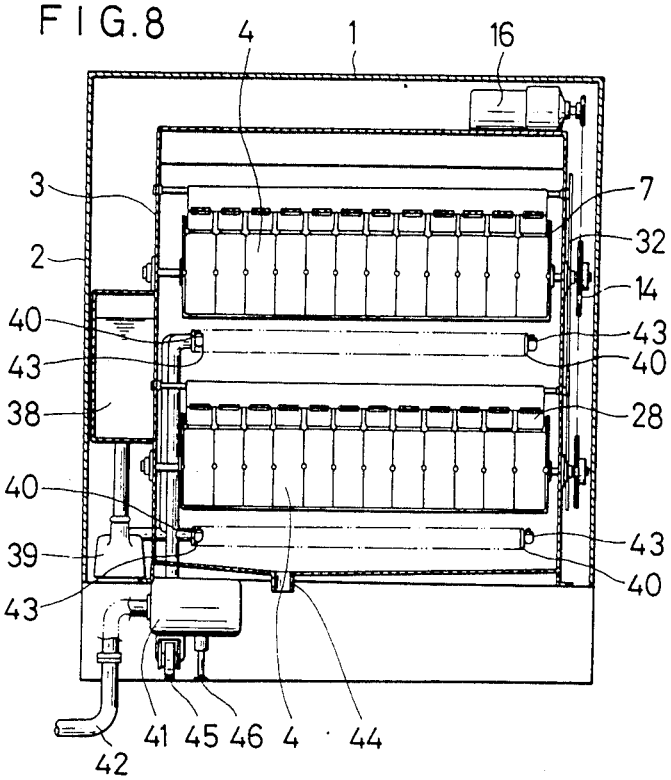
FIG. 8 is a front view of another embodiment showing nozzles for cleaning agent and washing water and rotation transfer means looking from the front.
Figure 9:
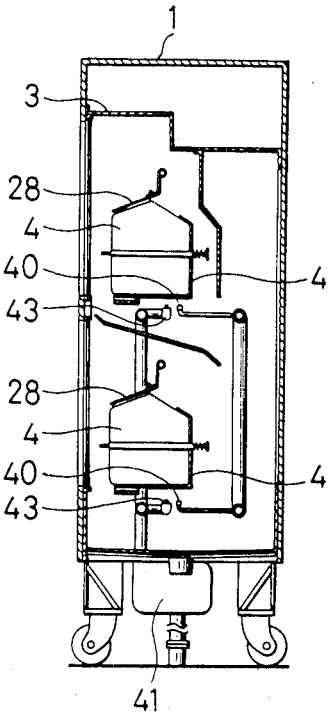
FIG. 9 is an enlarged perspective view showing a retained state of containers used to hold urine.
Figure 10:
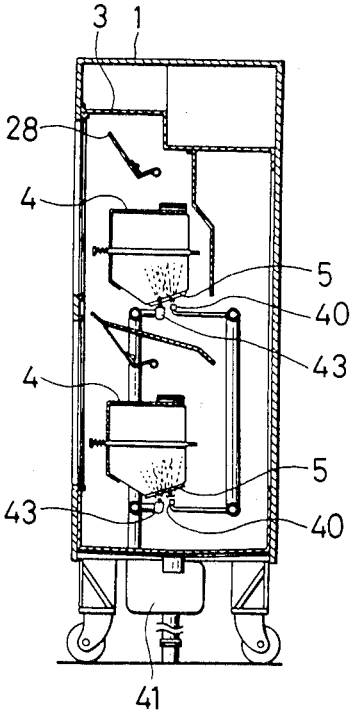
FIG. 10 is a sectional side view of a body looking from the side.

In the embodiment, the parallel moving mechanism 32 is constituted by a long link **32*a* disposed vertically and two short links 32*b*, 32*b* as shown in FIG. 4, and since the long link 32*a* is linked to the lower chain wheel 14 via a stopper pin, the cover 28** may be moved vertically interlocking with the rotation of the chain wheel.

Figure 2:
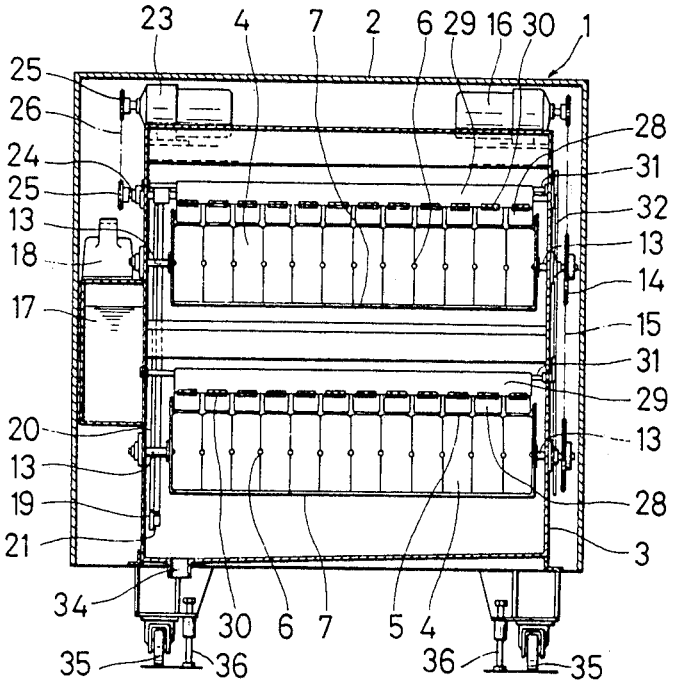
FIG. 2 is a front view showing nozzles for cleaning agent and washing water and rotation transfer means looking from the front.

In FIG. 1, a numeral 33 represents a control unit for the operation. In FIG. 2, a discharge outlet 34 for accumulated urine is formed on the lower surface of the case 3 inside the body 1. A numeral 35 represents a moving caster of the body 1 and a numeral 36 designates a level adjusting device, which is arranged near the caster 35 for retaining the level of the body 1. Although not shown, if a slidable screen will be provided at the opening on the front of the body 1, a deodorization effect may be increased.

When cleaning the container 4 according to the embodiment, a switch on the control unit 33 must be put on, then the rotating motor 16 of the retaining member 7 is driven and the retaining member 7 connected thereto via the chain 15 and the chain wheel 14 is rotated about the shaft 13 by a fixed angle. That is, the top opening 5 of the container 4 is rotated backward, simultaneously the supporting shaft 31 of the supporting portion 29 is rotated via the parallel moving mechanism 32 mating with the chain wheel 14 aforementioned, thus allowing the rotation of the cover 28 upward. Since the rotating speed of the supporting shaft 31 is faster than the shaft 13 of the retaining member 7, the cover 28 rotates so as not to hinder the rotation thereof. Now, the urine in each container 4 is discharged as the retaining member 7 rotates and the opening 5 of the container 4 retained thereby faces downward, then the rotation is stopped when the opening 5 of the container 4 has reached the position corresponding to both ejecting nozzles 19 and 21. In synchronism with the standstill, the pump 18 provided in the tank 17 for cleaning agent starts to operate and ejects cleaning agent into the container 4 previously mentioned, simultaneously the moving motor 23 of the nozzle is driven and the ejecting nozzle 19 for cleaning agent continues to move as ejecting cleaning agent into each container 4 and stops when reaching the container 4 at the utmost end, where the ejection is also stopped. Immediately thereafter, the nozzle moving motor 33 starts to rotate and moves a pair of nozzles 19 and 21 reversely to the above moving direction, which simultaneously washes inside each container 4 by ejecting the washing water from the washing water ejecting nozzle 21 and the movement of the both ejecting nozzles 19 and 21 and the ejection of washing water are stopped when the both ejecting nozzles 19 and 21 have returned to the position before the movement. As such, when the internal cleaning of each container 4 is completed, the rotating motor 16 is driven again and rotates reversely to the above rotating direction and stops when the retaining member 7 and the cover 28 have returned to the original state.

Meanwhile, in the embodiment, in the cleaning process of the container, although the internal cleaning of the container is completed when both ejecting nozzles start moving and return to the original position after a return trip between the containers arranged in parallel, it may be so constituted besides the above process that the cleaning of each container is accomplished by ejecting cleaning agent from the ejecting nozzle for cleaning agent while both ejecting nozzles are making a single or a plurality of return trips, then thereafter ejecting water from the ejecting nozzle for the washing water while both ejecting nozzles are making a single or a plurality of return trips or cleaning each container by ejecting cleaning agent and washing water by stopping both ejecting nozzles at each container.

In the embodiment, as described above since the ejecting nozzles for cleaning agent and washing water are disposed movably in a parallel direction of the containers, each container is not required to have an ejecting nozzle individually.

Thus, the apparatus is simple in construction, light in weight and can be manufactured readily and the containers used to hold urine may be cleaned automatically and efficiently with moving both ejecting nozzles. Furthermore, since the retaining member retaining each container in parallel is provided automatically movably, the urine in the container can be discharged simply automatically, thus the apparatus is clean and easy to operate.

Therefore, according to the embodiment, the washing apparatus for containers used to hold urine, which is most suitable for preserving the urine and washing the container in the hospital, the sanatorium and the research laboratory and so on may be provided.

Embodiment 2

In FIGS. 7 through 10, a numeral 37 represents a closing guard provided 15 a lower end of the body 1. A tank 38 for cleaning agent is disposed between the external casing 2 and the inner case 3 of the body 1 and a pump 39 is connected thereto. An ejecting nozzle 40 for cleaning agent is provided respectively under each container 4 previously mentioned and connected to the tank 38 via the pump 39. A pump 41 for washing water is disposed underneath the bottom of the body 1 and shown as being connected to a tap water pipe 42 in the embodiment shown in the drawing. However, it is not limited thereto, it may be connected to washing water tank provided separately.

An ejecting nozzle 43 for washing water is connected to the pump 41 in parallel to the piping of the ejecting nozzle 40 for cleaning agent, and a plurality of which are arranged together with the ejecting nozzle 40 under each container 4 corresponding respectively thereto.

A discharge outlet 44 for accumulated urine is formed in protrusion on the lower surface of the inner case 3 of the body 1. A numeral 45 represents a moving caster of the body 1. A level adjusting device 46 is disposed near the caster 45 for retaining the level of the body 1.

In the embodiment, the cleaning of the container may be accomplished in such a manner that, after the urine is discharged by rotating the container 4 by a fixed angle (refer to FIG. 10), cleaning a agent is ejected all at once into each container 4 from each ejecting nozzle 40 for cleaning agent corresponding to the opening 5 of each container 4, thereafter the pump provided in the washing water tank 41 is operated and washing water is ejected simultaneously into each container 4 arranged on the retaining member 7 from the ejecting nozzle 43 as same as the nozzle 40 for cleaning agent by the pressure thereof. When the cleaning of the container 4 is completed as such, the rotating motor 16 aforementioned is driven again and rotates reversely to the above rotating direction and stops when the retaining member 7 and the cover 28 have returned to the original state.

In the embodiment, as mentioned above, since each container is respectively provided with the ejecting nozzles for cleaning agent and washing water, the manual work can be omitted and the cleaning time can be shortened considerably, besides a mechanism for moving the ejecting nozzles is not needed, the troubles may be reduced. Moreover, since the retaining member retaining each container in parallel is disposed rotatably, the urine can be discharge simply, automatically and cleanly.

Therefore, according to the embodiment, the washing apparatus for containers used to hold urine which is most suitable for preserving the urine and washing the container in the hospital, the sanatorium and the research laboratory and so on may be provided.

Embodiment 3

Figure 11:
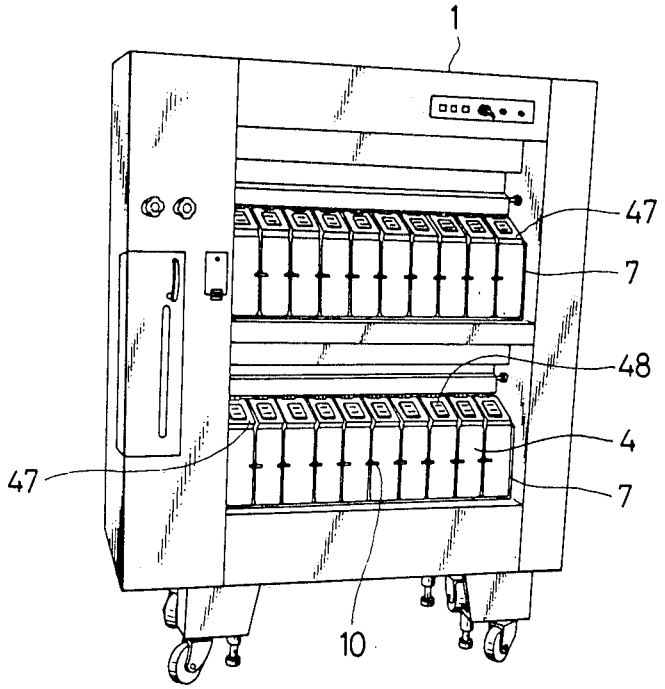
FIG. 11 is a perspective view of a washing apparatus showing a further another embodiment.
Figure 12:
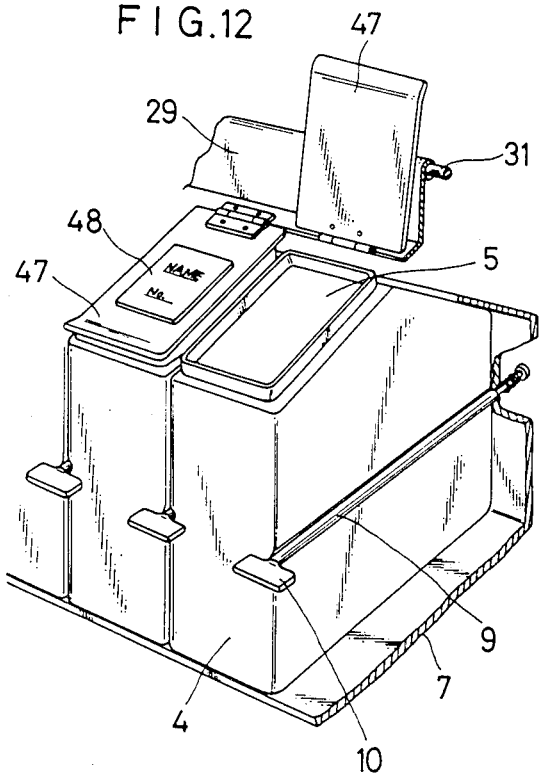
FIG. 12 is an enlarged perspective view showing another embodiment of a cover.

In FIGS. 11 and 12, a cover 47 is possible of covering the opening 5 of each container 4. A numeral 48 represents a plate or a sticker on which a name and so on are written and preferably used as a nameplate when attaching onto the cover 47.

In the embodiment, since the cover 47 is provided to each container for closing the opening thereof in an open and close fashion, a radiation of bad odor from the container and an entering of dust thereinto in the preserved state of the urine till washing may be prevented. Since the urine can be taken in and out from each container due to the cover opening and closing individually, the urine being spilt by accident will not enter the other container nor mixed with the urine therein. Then, as the embodiment, since the sticker 48 provided on the cover 47 for each container can be used as the nameplate, the name, the date and so on may be distinguished conveniently at a glance.

Meanwhile, since each cover is all constituted so as to rotate about the supporting shaft 31 via the supporting portion 29 in synchronism with the rotation of the retaining member 7, the rotation thereof will be not hindered. Besides, the retaining member rotates smoothly and discharges the urine in the container retained thereby and the inside of the container may be cleaned automatically and properly by ejecting cleaning agent and washing water, then after the completion of the cleaning the retaining member is reversed automatically, thereby returning the cover to the original state and the opening of each container is closed surely.

Therefore, according to the embodiment, the cleaning of the container can be accomplished hygienically and cleanly without bothering the person's hands, so the most suitable washing apparatus for containers used to hold urine for preserving the urine and for cleaning the container in the hospital, the sanatorium, the research laboratory and so on may be provided.

What is claimed is:

1. A movable apparatus for concurrently washing a plurality of containers used to hold urine, said containers being of generally rectangular shape with an opening in the top thereof for entry and exit of urine, said apparatus comprising housing means comprising a body and wheel means for movably positioning said body; and contained within said body, at least one retaining member for rotatably holding a plurality of said containers in an upright position with the opening located at the top, in one condition, and for rotating said containers and holding said containers with the opening located at the bottom, in another condition, said retaining member comprising a bottom plate, a pair of end plates and a rear plate, with said rear plate being inclined to hold said containers toward the top thereof;

means for rotating said retaining member to rotate said plurality of containers from said one condition to said another condition;

means for fixedly holding in a serial manner said plurality of containers on said retaining member comprising a plurality of rods disposed through said rear plate of said retaining member, spring means disposed on said rods on the backside of said rear plate, and also disposed on each rod a rotatable pressing piece shaped to allow selective placing of the containers on said retaining member when disposed vertically, and to lock said containers on said retaining member when disposed horizontally, with said spring means providing resilient force to hold said pressing piece against said container, wherein each set of said rod, spring means and said pressing piece is disposed between adjacent containers;

a plurality of cover means for covering said opening in said tops of said plurality of containers;

means for concurrently moving said plurality of cover means to open and close said opening in said tops of said containers;

nozzle means disposed below said retaining member at a distance below said opening in said containers when said containers are rotated and held in said another condition with the openings thereof located at the bottom, said nozzle means ejecting fluid to wash the inside of said containers; and means for causing said means for moving said cover means to concurrently move said plurality of cover means from said opening in said tops of said containers prior to or, in the alternative concurrently with said means for rotating said retaining member causing said retaining member to rotate said containers from said one condition to said another condition thereby to cause urine to emptied from said containers through said openings and furthermore for causing said nozzle means to eject fluid into said inside of said containers to wash said containers.

2. The apparatus of claim 1, wherein said nozzle means comprises two nozzles, one used to eject cleaning agent and another to eject water.

3. The apparatus of claim 1, wherein said nozzle means comprises a pair of nozzles and means for moving said pair of nozzles reciprocally in a direction from one end plate to the other end plate of said retaining member.

4. The apparatus of claim 1, wherein said nozzle means comprises a plurality of first nozzles used to eject cleaning agent and a plurality of second nozzles used to eject water, with one first nozzle and one second nozzle disposed below each container.

5. The apparatus of claim 1, wherein said containers comprise transparent synthetic resin and are provided with a scale on the front surface thereof.

6. The apparatus of claim 1, wherein said means for rotating said retaining member comprises a motor, a chain wheel and a chain disposed between said motor and said chain wheel.

7. The apparatus of claim 1, wherein said means for moving said plurality of cover means comprises a supporting portion, a supporting shaft and motor means connected to said supporting shaft, wherein said cover means are hinged to said supporting portion.

* * * * *